United States Patent [19]

Mabuchi

[11] 4,276,716

[45] Jul. 7, 1981

[54] MULTI-STAGE ENERGY STORAGE DEVICE

[75] Inventor: Kenichi Mabuchi, Matsudo, Japan

[73] Assignee: Mabuchi Motor Co, Ltd, Tokyo, Japan

[21] Appl. No.: 12,008

[22] Filed: Feb. 14, 1979

[30] Foreign Application Priority Data

Feb. 17, 1978 [JP] Japan ..... 53-17262
Feb. 17, 1978 [JP] Japan ..... 53-19257[U]
Feb. 18, 1978 [JP] Japan ..... 53-18026

[51] Int. Cl.[3] ..... A63H 17/00; F03G 1/00

[52] U.S. Cl. ..... 46/206; 185/9; 185/45; 185/DIG. 1; 46/208

[58] Field of Search ..... 46/206, 208, 78, 92–94; 185/DIG. 1, 37, 45, 9

[56] References Cited

U.S. PATENT DOCUMENTS

| | | | |
|---|---|---|---|
| 1,076,314 | 10/1913 | Pitman | 185/45 |
| 2,100,590 | 11/1937 | Grady | 46/78 |
| 2,749,660 | 6/1956 | Zimentstark | 46/206 |
| 3,602,337 | 8/1971 | Cain | 185/DIG. 1 X |

FOREIGN PATENT DOCUMENTS

| | | | |
|---|---|---|---|
| 812844 | 5/1937 | France | 46/78 |

*Primary Examiner*—Jay N. Eskovitz
*Assistant Examiner*—Mickey Yu

[57] ABSTRACT

A multi-stage energy storage device having a multi-stage construction of energy storage units adapted to uniformly distribute energies stored to each stage, and its embodiments are disclosed.

11 Claims, 6 Drawing Figures

MULTI-STAGE ENERGY STORAGE DEVICE

BACKGROUND OF THE INVENTION

1. Field of the Invention

This invention relates generally to a multi-stage energy storage device, and more specifically to a multi-stage energy storage device having a multi-stage construction of energy storage units wherein energy is stored in a given stage of energy storage unit by means of the energy previously stored in the preceding stage of energy storage unit so as to obtain a relatively compact assembly incorporating a multiplicity of energy storage units to store large energy as a whole.

2. Description of the Prior Art

In a multi-stage energy storage unit, it is generally desired that each stage of energy storage units should almost uniformly store energy.

However, when storing energy in a given stage of energy storage unit by transmitting the energy previously stored in a preceding stage of energy storage unit to the said stage of energy storage unit, energy loss is usually caused in an energy transmitting mechanism intervening between the two stages of the multi-stage energy storage unit. When an energy transmitting mechanism employing two intermeshing gears of the same tooth number is used in such a case, energy may not be sufficiently transmitted from the preceding stage to the said stage due to the energy loss mentioned above. That is, whereas larger energy tends to be stored in the preceding stage, less energy in the said stage. This invention is intended to practically uniformly distribute energies to be stored to each stage of a multi-stage energy storage unit.

SUMMARY OF THE INVENTION

It is an object of the present invention to provide a multi-stage energy storage device designed to uniformly store energy in each stage constituting the multi-stage energy storage device.

It is another object of the present invention to provide a multi-stage energy storage device using energy storage units of different properties in each stage.

It is still another object of the present invention to provide a toy car having a drive unit using elastic cordage as a multi-stage power source.

It is a further object of the present invention to provide a toy car having a drive unit in which a plurality of elastic cords are arranged in parallel.

It is still a further object of the present invention to provide a toy car having a drive unit wherein hooks of the parallelly arranged elastic cords are made slidable by the use of a tensioner.

It is still a further object of the present invention to provide a toy car having a drive unit wherein a tension adjusting device is provided to the tensioner.

It is still a further object of the present invention to provide a toy car having a drive unit wherein a plurality of elasticity adjusting members are provided as a tensioner.

It is still a further object of the present invention to provide a toy car having a drive unit wherein a rubber band of an equilaterial triangle shape is used as an elasticity adjusting member.

It is still a further object of the present invention to provide a toy car having a drive unit wherein one or more helical springs are used as elasticity adjusting members.

DETAILED DESCRIPTION OF THE EMBODIMENT

Figure 2:
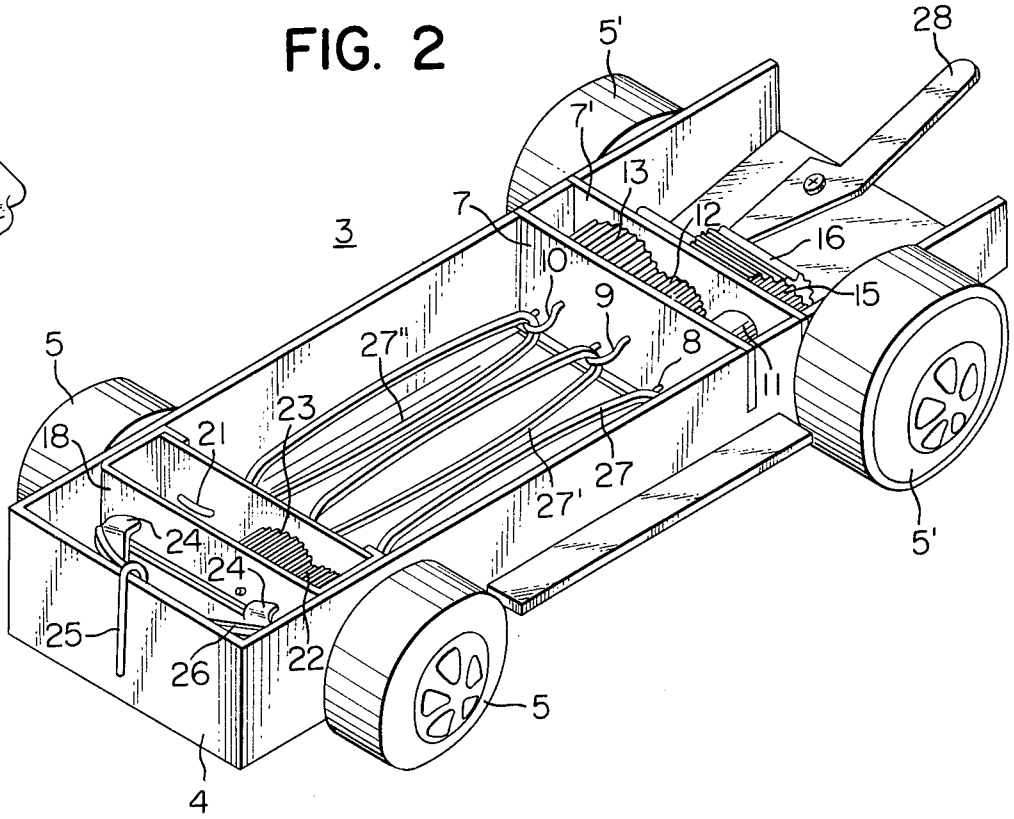
FIGS. 2, 3 and 4 are diagrams illustrating a multi-stage energy storage device according to this invention incorporated into the miniature car 1 whose body 2 is removed.
Figure 1:
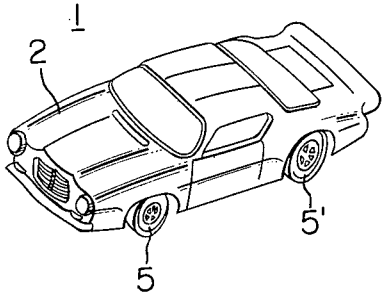
FIG. 1 shows a miniature toy car 1 incorporating a multistage energy storage device of this invention.
Figure 3:
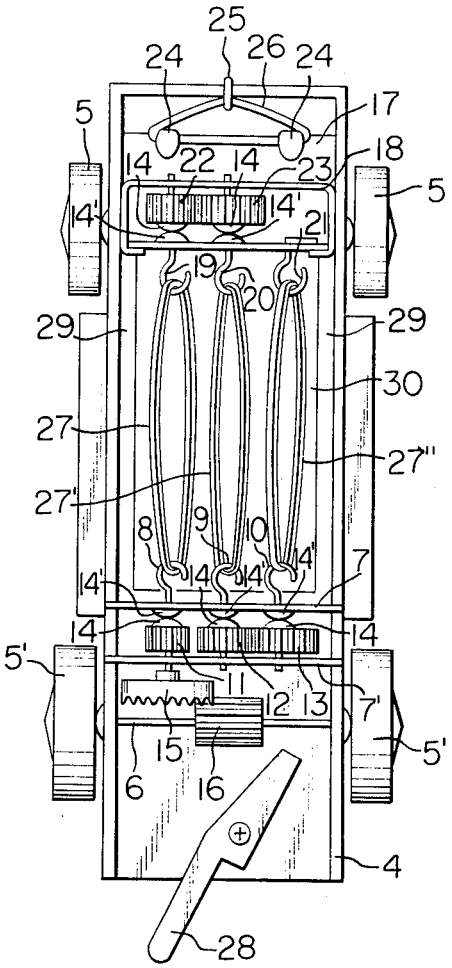
Figure 4:
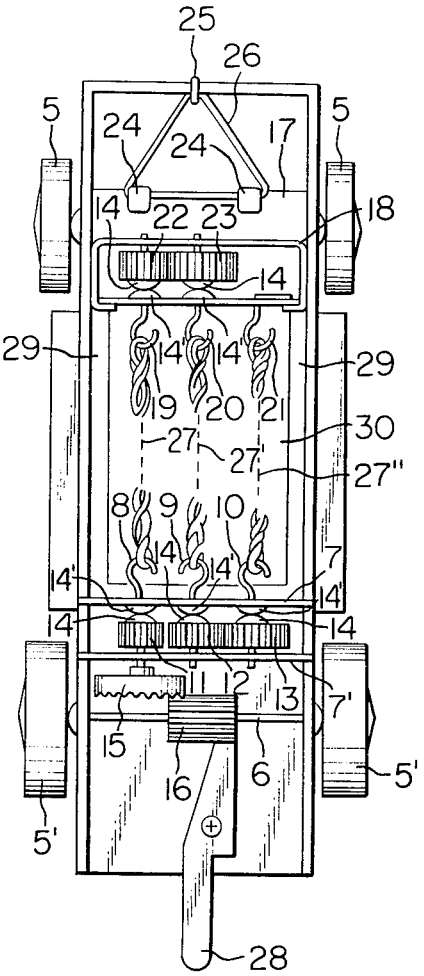
Figure 6:
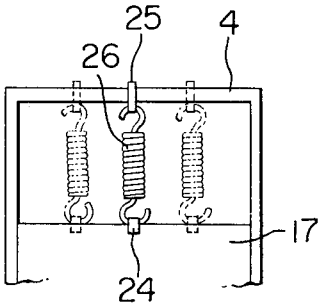
FIG. 6 illustrates another embodiment of a tension adjusting device of this invention.

A multi-stage energy storage device embodying this invention is incorporated in a chassis frame 4 constituting a chassis 3 in a miniature car 1. Partitioning plates 7 and 7' are fixed to the chassis frame 4, and a plurality of hooks 8, 9 and 10 (three hooks in the figure) are passed through the partitioning plates 7 and 7' and rotatably supported by the partitioning plates 7 and 7'. A gear 11 is fixed to the hook 8 while gears 12 and 13 which are in mesh with each other but not in mesh with gear 11 are fixed to the hooks 9 and 10, respectively. Metallic thrust bearings 14 are fitted to the gear 11 and the gears 12 and 13, constituting low friction bearings in conjunction with metallic thrust bearings 14' fitted to the partitioning plate 7. A crown gear 15 is fixed to the rear end of the hook 8 and is in mesh with a pinion gear 16. The pinion gear 16 is fixed to an axle 6 of rear wheels 5' and 5'. On the chassis frame 4, front wheels 5 and 5 are mounted, constituting the wheels of the miniature car 1, together with the rear wheels 5' and 5'. Furthermore, a movable plate 17 is slidably fitted to the chassis frame 4. The movable plate 17 rests slidably mounted on an internal edge 28 of the chassis frame 4, though not clearly shown in the figures. Needless to say, the movable plate 17 may be made longitudinally slidable by providing shallow grooves both sides of the chassis frame 4 near and along the bottom surface of the chassis frame 4 and inserting the side edge of the movable plate 17 into the shallow grooves. A frame member 18 is fixed to the movable plate 17, and hooks 19, 20 and 21 are supported by the frame member 18, the hooks 19 and 20 being rotatably supported and the hook 21 being fixedly supported. Gears 22 and 23 are fixed to the hooks 19 and 20, and metallic thrust bearings 14 and 14' are provided on the gears 22 and 23 and the frame member 18 to reduce friction. A pair of projections 24 and 24 are formed on the movable plate 17. A tensioner such as a rubber band 26 is provided between the projections 24 and 24 and a clip 25 fixed to the chassis frame 4 so that the movable plate 17 can be uniformly pulled toward the front of the car. In FIGS. 3 and 4, the movable plate 17 is uniformly pulled by stretching the rubber band 26 in the form of an equilateral triangle between the two projections 24 and the clip 25. Needless to say, the rubber band 26 may be stretched between two points of a projection 24 and a clip 25, each provided on the centerline of the car. Furthermore, two or more pairs of projections 24 and clips 25 may be provided at equal spacings on the chassis frame 4 and the movable plate 17, respectively, so that a plurality of rubber bands or small coil springs 26' may be used to uniformly pull the movable plate 17, as shown in FIG. 6. Rubber bands 27, 27' and 27'' are stretched between the hooks 8, 9 and 10 and the hooks 19, 20 and 21. A stopper 28 is pivotally fitted to the chassis frame 4 to lock the rotation of the pinion gear 16 to prevent the energies stored in the rubber bands 27, 27' and 27'' from being unwantedly released.

Now, the method to store energy in the rubber bands 27, 27' and 27'' will be described. Assume that the wheels 5 and 5' are rotated, for example, by hand after the stopper 28 is pivoted to release the locked pinion gear 16, as shown in FIG. 3. The rotation of the wheels 5' and 5' causes the shaft 6 and the pinion gear 16 fixed thereto to rotate. The rotation of the pinion gear 16 causes the crown gear 15 and the hook 8 to rotate, thus causing the rubber band 27 hooked to the hook 8 to twist. The twisting of the rubber band 27 causes the hook 19 to rotate, causing the hook 20 adjacent to the hook 19 to rotate via the gears 22 and 23 to twist the second stage rubber band 27'. The twist of the rubber band 27' causes the hook 9 to rotate, causing the twisting energy to be transmitted to the third stage rubber band 27'' via the gears 12 and 13. In this way, the continuous rotation of the wheels 5' and 5' by hand and other rotating means causes the rubber bands 27, 27' and 27'' one by one to store the energy in them.

In the initial stage where no energy is stored in the rubber bands 27, 27' and 27'', the movable plate 17 is slightly tensioned by the rubber band 26 serving as a tensioner. However, as energy is gradually stored in the rubber bands 27, 27' and 27'' as shown in FIG. 4, the rubber bands 27, 27' and 27'' are increasingly twisted, forming "knots" on them, exerting strong tension forces between the hooks 8, 9 and 10 and the hooks 19, 20 and 21, respectively, as shown in FIG. 4. However, the rubber band 26 acting as a tensioner keeps pulling the movable plate 17 while resisting the above-mentioned tension force, permitting the rubber bands 27, 27' and 27'' to be wound in a constantly tensioned state without slackening. This prevents the occurrence of knots, which are often caused when winding a slackened rubber band, resulting in uniform distribution of the stored energy. The tension of this rubber band 26 is of course effective not only in storing energy but also in uniformly releasing the stored energy.

Figure 5:
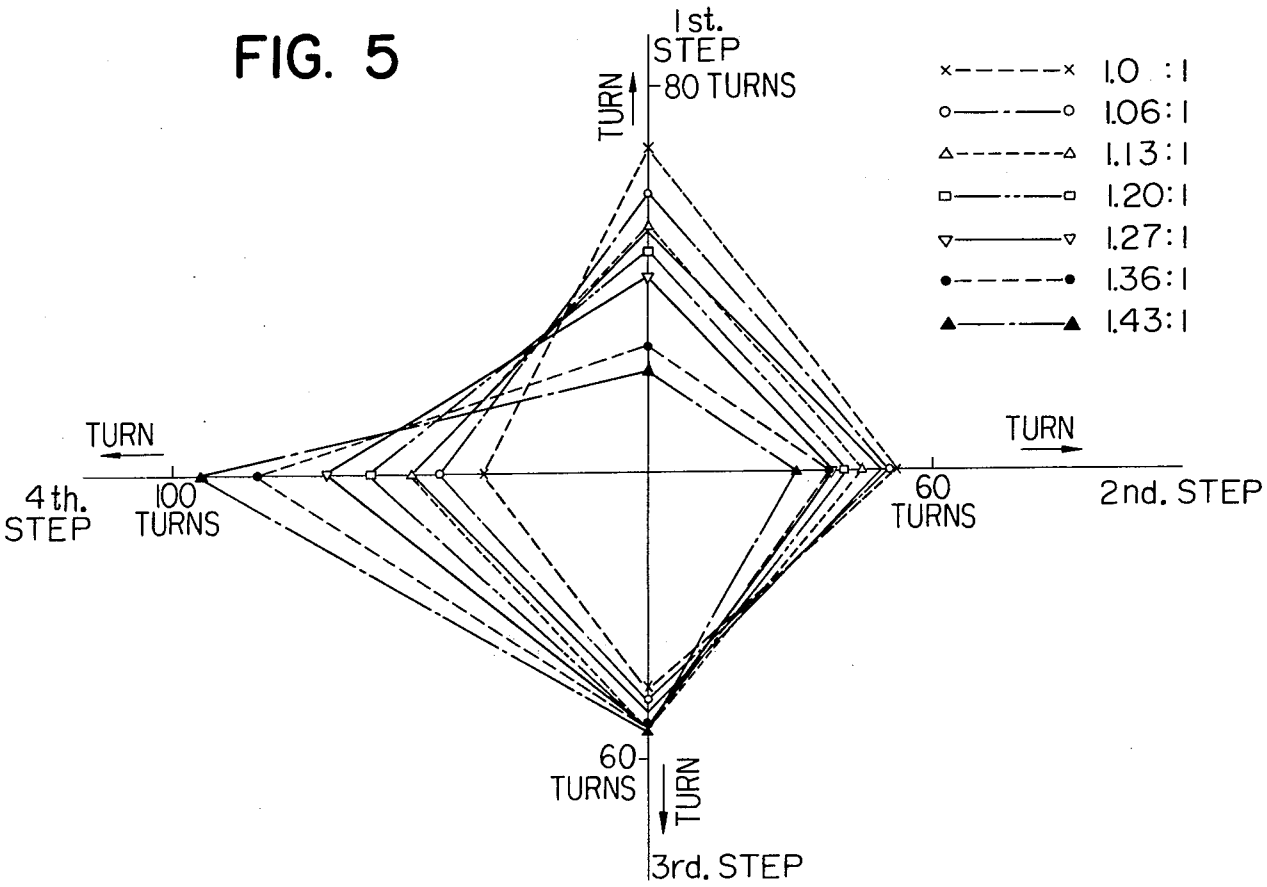
FIG. 5 is a graph illustrating the relationship between gear ratios and energies stored in each stage of energy storage units in an energy storage device of this invention wherein four stages of energy storage units using rubber bands are employed as an energy storage source and gears are used as an energy transmitting mechanism.

The gear ratios between the gears 12 and 13 and between the gears 22 and 23 are not 1:1, the succeeding stage gears 13 and 23 have a slightly larger tooth number compared with the gears 12 and 22. Since hooks and gears inevitably produce slight friction forces, causing an energy loss due to the friction, the gear ratios of the succeeding stage gears have to be increased by the amount corresponding to the friction loss in order to increase the twist torque of the succeeding stage rubber bands by that amount. Otherwise, the rubber bands 27, 27' and 27'' would not be wound uniformly, resulting in uneven and inadequate storage of energy. This would pose a problem of frequent breakage of a particular rubber band. The gear ratio varies with the state of friction loss. However, when driving a miniature car equipped with ordinary gears and metallic thrust bearings for toys, the optimum gear ratio is on the order of 1.43. Particularly, in the range of 1.06–1.20, rubber bands of each stage are wound to almost the same number of turn. When the rubber bands 27, 27' and 27'' are sufficiently wound and sufficient energy is accumulated in the rubber bands 27, 27' and 27'', the stopper 28 is engaged to the pinion gear 16 to lock the rotation of the pinion gear 16. When the miniature car 1 is placed on the floor and the stopper 28 is disengaged from the pinion gear 16 to release the stored energy, the miniature car 1 starts running, driven by the energy stored in the rubber bands 27, 27' and 27''. When three commercially available rubber bands, each about 5.5 cm long, are used for each stage of the energy storage device, a miniature car about 7 cm long can be driven over a distance of approximately 12 m. By increasing the number of stages or using more than two rubber bands on each hook, more energy can be stored. Rubber bands to be used in the device of this invention are not limited to commercially available rubber bands, as mentioned above, rubber strings and other suitable rubber materials can be used. The means to transmit power to the wheel 5' and 5' is not limited to a pinion gear and a crown gear. For example, bevel gears can be used. The gears 12, 13 and 22 and 23 may be replaced with friction wheels, for example. A multi-stage construction can be designed by fixing a crown gear to hooks on the inside, and arranging gears on both sides of the gears fixed to the hooks. Test data on a four-stage energy storage device of this invention, using commercially available rubber bands will be described, referring to FIG. 5. In the figure, four cordinate axes represent the number of turns of each rubber band of the first, second, third and fourth stages. FIG. 5 illustrates changes in the energies stored in each stage in the form of the number of turns when rubber bands of each stage are wound so that the total sum of the number of turns amounts to approximately 200 turns and the gear ratios of the gears 12 and 13 and the gears 22 and 23 are varied from 1:1.0 to 1:1.43. In an ideal state, the total number of turns is uniformly distributed to each stage, that is, 50 turns per stage. However, when gears of the same gear ratio are used, the first stage rubber band is wound to 67 turns, the second stage rubber band to 53 turns, the third stage rubber band to 45 turns and the fourth stage rubber band to 35 turns. In other words, a lower stage gear is wound more, indicating that it is harder for succeeding stage gears to receive energy due to friction loss, as mentioned above. When the gear ratios are changed to 1:1.06, however, the first stage rubber band is wound to 58 turns, the second one to 51 turns, the third one to 47 turns and the fourth one to 44 turns, respectively, indicating that rubber bands of each stage are wound more uniformly. In this experiment, the state close to the ideal one is obtained at the gear ratios of 1:1.13. By further increasing the gear ratios, on the contrary, the energy transmitting torque is increased, and accordingly the number of turns in the succeeding stage rubber bands. This is only an experiment illustrating a trend. It is estimated that the distribution of the number of turns varies with the properties of the rubber to be used and the distribution of friction in the device. The optimum gear ratios, therefore, vary with these parameters.

Description has been made in the above about the embodiments using rubber bands of the same properties in each stage of the energy storage device, but it is needless to say that rubber bands of different properties can be used in the energy storage device, and that when rubber bands having lower elasticity by the amount corresponding to friction loss are used in the second and subsequent stages of the energy storage device, gears of the same gear ratio can be used for the energy transmission. As the energy storage source, not only rubber and other resilient materials but also other appropriate means such as flywheels and springs can be used.

As described above, this invention makes it possible to uniformly store energy in multiple stages of an energy storage portion using rubber bands and other suitable materials via a torque increasing means such as gears having gear ratio larger than 1, or to store energy in each stage of the energy storage device in a balanced loading state by constructing the latter stages of energy storage means of energy storage materials of different properties from those of the preceding stages, for example, of lower elasticity by the amount corresponding to friction loss.

This invention, therefore, makes it possible to provide a multi-stage energy storage device of a very simple construction which can be housed in a limited space and can efficiently store a large amount of energy. Furthermore, even for a toy car whose length is too short to house long rubber bands, this invention makes it possible to provide a prime mover capable of storing a large amount of energy by increasing the number of energy storage stages in the transverse direction.

What is claimed is:

1. A multi-stage energy storage toy car comprising a chassis frame; a plate that is slidably mounted on and movable with respect to one end of said chassis frame; a plurality of pairs of hooks mounted rotatably on said plate and on one end of said chassis frame whereby said hooks are arranged in spacedly opposed pairs; at least one elongated elastic member stretched in the length direction of said chassis frame between each pair of said hooks, each said elastic member being adapted to store energy when twisted about its own longitudinal axis; a tensioner for displacing said movable plate in one direction and for maintaining said movable plate in the displaced position, said tensioner being provided between said chassis frame and said movable plate; an energy transmitting mechanism for transmitting the elastic energy stored in said elastic members after the twisting thereof; and a power transmitting portion which is coupled to said hooks between which said elastic members are stretched, said energy transmitting mechanism being constructed so as to increase the driving torque when transmitting the energy stored in said elastic member located on one side of said car to said elastic member located on the other side of said car.

2. A multi-stage energy storage toy car as set forth in claim 1 wherein said chassis frame includes an internal cavity in which said elastic members are housed as a prime mover and wheels, said power transmitting portion being coupled to said wheels for transmitting drive force from the prime mover to the wheels; and wherein the elastic members are secured at one end to a support provided on the chassis frame and at the other end to the movable plate, the movable plated being slidably mounted for movement in a longitudinal direction with respect to the longitudinal axes of the elastic members, said tensioner being mounted between a portion of the chassis frame and a portion of the movable plate so that a tension force is applied to the elastic members to uniformly distribute winding force to all the elastic members.

3. A multi-stage energy storage toy car as set forth in claim 1 wherein said tensioner comprises at least one elastic member that is fixed at one end to an internal portion of the cavity of the chassis frame and at the other end to the movable plate so as to keep pulling the movable plate to one end of the chassis frame cavity.

4. A multi-stage energy storage toy car as set forth in claim 1 wherein said tensioner comprises at least one rubber band stretched in an equilateral triangle shape with a fixed part of the chassis frame as a vertex and mounting portions on the movable plate as a base so as to keep pulling the movable plate to one end of the chassis frame cavity.

5. A multi-stage energy storage toy car as set forth in claim 1 wherein said tensioner comprises a plurality of helical springs of the same tension disposed at equal lateral spacings, said springs being in parallel with each other in the width direction of said chassis frame and extending between a fixed part of the chassis frame and mounting portions of the movable plate so as to exert a substantially uniform force on the movable plate.

6. A multi-stage energy storage toy car as set forth in claim 1 wherein there are three of said elastic members each of with is approximately 5.5 cm long.

7. A multi-stage energy storage toy car as set forth in claim 1 wherein there are a plurality of said elastic members extending between each pair of said hooks.

8. A multi-stage energy storage toy car as set forth in claim 1 wherein said energy transmitting means comprises a first gear coupled to a first one of said hooks, a second gear coupled to a second one of said hooks that define a first pair of hooks in combination with said first hook, a third gear in mesh with said second gear and coupled to a third hook adjacent said second hook, a fourth gear coupled to a fourth one of said hooks that defines a second pair of hooks in combination with said third hook and a fifth gear in mesh with said fourth gear and coupled to a fifth hook adjacent to said fourth hook, there being further included a sixth hook opposite said fifth hook and defining there with another pair of hooks, said sixth hook being devoid of any gear coupled thereto.

9. A multi-stage energy storage toy car as set forth in claim 8 wherein said third gear and said fifth gear have a greater number of teeth than said second gear and said fourth gear, respectively.

10. A multi-stage energy storage toy car as set forth in claim 8 wherein the gear ratio between said fourth gear and said fifth gear, and between said second and said third gear is in the range of 1.06–1.20 to 1.

11. A multi-stage energy storage toy car as set forth in claim 8 wherein the gear ratio between said fourth gear and said fifth gear and between said second gear and said third gear is approximately 1.43 to 1.

* * * * *